United States Patent [19]

Moring, III

[11] Patent Number: 4,860,853

[45] Date of Patent: Aug. 29, 1989

[54] STAMP FORMED MUFFLER WITH NONPLANAR ARRAY OF TUBES

[75] Inventor: Walter G. Moring, III, Toledo, Ohio

[73] Assignee: AP Parts Manufacturing Company, Toledo, Ohio

[21] Appl. No.: 287,391

[22] Filed: Dec. 20, 1988

[51] Int. Cl.[4] ..... F01N 1/02; F01N 7/18

[52] U.S. Cl. ..... 181/282; 181/228; 181/243; 181/250; 181/268; 181/272; 181/273

[58] Field of Search ..... 181/204, 212, 228, 230, 181/240, 243, 250, 255, 268, 272, 273, 282

[56] References Cited

U.S. PATENT DOCUMENTS

| | | | |
|---|---|---|---|
| 705,357 | 7/1902 | Keating . | |
| 1,110,040 | 9/1914 | Chatain . | |
| 2,484,826 | 10/1949 | Harley . | |
| 2,484,827 | 10/1949 | Harley . | |
| 2,658,580 | 11/1953 | Trembley . | |
| 2,860,722 | 11/1958 | Gerstung . | |
| 2,902,109 | 9/1959 | Burgess et al. . | |
| 2,943,695 | 7/1960 | Jeffords | 181/243 |
| 3,125,182 | 3/1964 | Earley . | |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,198,284 | 8/1965 | Powers . | |
| 3,220,508 | 11/1965 | Nordquest et al. . | |
| 3,412,825 | 11/1968 | Hall . | |
| 3,638,756 | 2/1972 | Thiele | 181/245 |
| 3,650,354 | 3/1972 | Gordon . | |
| 3,709,320 | 1/1973 | Höllerl et al. . | |
| 3,827,529 | 8/1974 | Frietzsche et al. . | |
| 3,852,041 | 12/1974 | Moore et al. . | |
| 4,108,274 | 8/1978 | Snyder | 181/229 |
| 4,109,751 | 8/1978 | Kabele | 181/247 |
| 4,132,286 | 1/1979 | Hasui et al. | 181/265 |
| 4,165,798 | 8/1979 | Martinez | 181/268 |
| 4,396,090 | 8/1983 | Wolfhugel | 181/282 |
| 4,415,059 | 11/1983 | Hayashi | 181/250 |
| 4,418,790 | 12/1983 | Agnew | 181/268 |
| 4,422,519 | 12/1983 | Nomura et al. | 181/228 X |
| 4,456,091 | 6/1984 | Blanchot | 181/282 |
| 4,523,660 | 6/1985 | Gaddi | 180/228 |
| 4,700,806 | 10/1987 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |

FOREIGN PATENT DOCUMENTS

| | | |
|---|---|---|
| 59-155528 | 9/1984 | Japan . |
| 59-43456 | 12/1984 | Japan . |
| 60-111011 | 6/1985 | Japan . |
| 61-14565 | 5/1986 | Japan . |
| 61-108821 | 5/1986 | Japan . |
| 61-155625 | 7/1986 | Japan . |
| 632013 | 1/1950 | United Kingdom . |
| 1012463 | 12/1965 | United Kingdom . |
| 2120318 | 11/1983 | United Kingdom . |

*Primary Examiner*—B. R. Fuller

*Attorney, Agent, or Firm*—Anthony J. Casella; Gerald E. Hespos

[57] ABSTRACT

A stamp formed muffler is provided with a nonplanar array of tubes. The tubes are defined by at least one pair of nested formed members. The nested members include at least one external shell having a nonplanar portion and at least one internal plate having a nonplanar portion, with the respective nonplanar portions being configured to be placed in generally nested face-to-face relationship. The nonplanar configuration comprises an array of channels, such that an array of tubes is defined by the channels when the components are placed in nested relationship to one another. One or more chambers of the muffler are defined adjacent the nested formed members. The chambers may be defined by a single plate placed in register with the nested components or by a second pair of nested members. The nested pairs of formed members is effective in dampening shell noise attributable to vibration of the formed members.

16 Claims, 5 Drawing Sheets

STAMP FORMED MUFFLER WITH NONPLANAR ARRAY OF TUBES

BACKGROUND OF THE INVENTION

Most prior art exhaust mufflers comprise parallel tubes supported by transversely extending oval or circular baffles. The assembly of the parallel tubes and transverse baffles is slid within a tubular outer shell having a cross-sectional size and shape conforming to the shape of the baffles. An outer wrapper may then be wrapped about the outer shell to define a double-layer outer wall for the muffler. The double wall construction provided by the outer wrapper is intended to dampen shell ring, which is noise that would be generated by vibrations of a single layer outer wall. A pair of opposed end caps are then mechanically connected to the tubular outer shell and the outer wrapper to enclose the opposed longitudinal ends of the muffler. The end caps are provided with inlet and outlet apertures to permit the flow of exhaust gas through the muffler. With this prior art construction, a plurality of chambers are defined within the muffler. In particular, each chamber will be defined by the outer shell of the muffler and either two baffles or one baffle and an end cap. The tubes of these typical prior art mufflers are located and configured to permit communication of exhaust gases with the chambers defined inside the muffler. For example, the tubes may be provided with perforations, louvers or apertures which permit the flow or expansion of exhaust gases into a chamber. In other situations, a tube may terminate within a chamber to permit the crossflow of exhaust gases into another tube or to permit the dampening of certain low frequency sounds within an enclosed chamber.

The above described typical prior art muffler generally attenuates noise adequately. However, these prior art mufflers are undesirable in that they include a large number of separate components which must be manufactured and assembled in labor intensive manufacturing processes. These prior art mufflers also typically are undesirably heavy. Additionally, the above described prior art mufflers with tubular outer shells invariably have a generally rectangular plan view configuration. This limitation on the shape of the prior art muffler has made it extremely difficult to design the muffler to fit within the limited available space on the underside of a vehicle.

The prior art also includes mufflers formed at least in part from stamp formed components. For example, U.S. Pat. No. 4,396,090 which issued to Wolfhugel on August 2, 1983 shows a muffler having a pair of internal plates stamp formed to define pairs of opposed channels. The internal plates are assembled to one another such that each pair of opposed channels defines a tube therebetween. The internal plates defining the channels are disposed within a conventional wrapped outer shell as in the above described prior art conventional muffler.

The prior art also includes mufflers consisting of only two opposed shells which are stamped to define a convoluted array of tubes and chambers through which the exhaust gas may travel. Mufflers of this general type are shown in U.S. Pat. No. 3,176,791 which issued to Betts et al on April 6, 1965 and U.S. Pat. No. 3,638,756 which issued to Thiele on February 1, 1972.

The prior art further includes mufflers formed from more than two stamped components. Mufflers of this general type comprise a pair of internal plates stamped to define opposed channels such that when the plates are disposed in face-to-face relationship, the juxtaposed channels define tubes between the plates. Selected portions of these tubes have been provided with arrays of perforations, louvers or the like extending therethrough to permit the expansion of exhaust gases therefrom. These prior art mufflers further comprise a pair of stamp formed external shells which are disposed around the internal plates to define a chamber surrounding portions of the formed tubes having perforations, louvers, apertures or the like extending therethrough. Certain of these prior art mufflers further have included separate baffles extending between the internal plates and the external shell to define a greater number of chambers within the muffler. Examples of mufflers of this general type are shown in British Patent No. 632,013 which issued to White in 1949; British Patent No. 1,012,463 which issued to Woolgar on December 8, 1965; Japanese Published Patent Application No. 59-43456 which was published in 1984; U.S. Pat. No. 4,132,286 which issued to Hasui et al on January 2, 1979 and U.S. Pat. No. 4,415,059 which issued to Hayashi on November 15, 1983.

The above described prior art stamp formed mufflers have not received significant commercial success in the United States. In particular, these prior art stamp formed mufflers have generally conformed to the same rectangular plan view configuration of the conventional prior art mufflers with wrapped outer shells. As a result, the above described stamp formed mufflers have offered no advantage in packaging convenience. Additionally, the above described prior art stamp formed mufflers have functionally relied substantially entirely upon expansion chambers for attenuation of noise. However, mufflers relying exclusively upon expansion chambers generally fail to attenuate certain low frequency noise. These residual low frequency noises often have been acceptable on certain European cars. However, the residual low frequency noise associated with the above referenced prior art stamp formed mufflers has generally not been accepted in the United States.

Recently several significant advances have been made in stamp formed mufflers. In particular, U.S. Pat. No. 4,700,806 which issued to Jon Harwood on October 20, 1987 shows a muffler formed from stamp formed components and providing the combination of at least one tuning tube and at least one low frequency resonating chamber. Mufflers manufactured in accordance with U.S. Pat. No. 4,700,806 have proved extremely successful in attenuating both high frequency and low frequency noise, and have achieved very substantial commercial success in a short period of time. Other improvements relating to stamped mufflers are shown in U.S. Pat. No. 4,736,817 which issued to Jon Harwood on April 12, 1988; U.S. Pat. No. 4,759,423 which issued to Jon Harwood et al on July 26, 1988; U.S. Pat. No. 4,760,894 which issued to Jon Harwood et al on August 2, 1988 and U.S. Pat No. 4,765,437 which issued to Jon Harwood et al on August 23, 1988. All of the above described Harwood patents are assigned to the assignee of the subject invention, and the disclosures thereof are incorporated herein by reference.

All of the above described stamp formed mufflers which comprise arrays of formed tubes have the tubes defined by a pair of opposed generally planar plates having channels formed therein. Thus, with the possible exception of the inlet and outlet to the muffler, the central axes of the formed tubes have been generally planar. Additionally, those prior art mufflers formed from four separate plates have generally shown the tubes being defined by the two formed internal plates and the chambers being defined sustantially by the two external shells.

As noted above, mufflers have a tendency to produce shell ring, which is attributable to vibrations in the walls of the external shell of the muffler. The conventional mufflers avoid the shell ring by providing a separate outer wrapper to dampen the vibrations of the tubular shell of the muffler. The provision of the outer wrapper, however, imposes substantial weight and cost penalties. The prior art stamped mufflers that have been marketed in Europe over the years have largely tolerated higher noise levels, and therefore have generally not addressed the issue of shell ring. The problems associated with shell ring have been addressed in co-pending U.S. Pat. Application Ser. No. 227,807 which was filed by the inventors herein on August 3, 1988 and is entitled Stamp Formed Muffler With Reinforced Outer Shell. Despite the advantages of the construction shown in co-pending Application Serial No. 227,807, it is desired to provide further options for the construction of mufflers that will substantially eliminate shell ring.

It is also an object of the subject invention to provide a stamp formed muffler with a nonplanar array of tubes.

It is another object of the subject invention to provide a stamp formed muffler wherein the tubes are defined between one internal plate and one external shell.

It is an additional object of the subject invention to provide a stamp formed muffler wherein an internal plate having channels therein is secured to the external shell to reinforce the external shell and thereby attenuate shell ring.

Still another object of the subject invention is to provide a stamp formed muffler wherein the chambers are generally internally disposed, and wherein the tubes are disposed adjacent the external shells.

A further object of the subject invention is to provide a stamp formed muffler with a nonplanar array of tubes and with a generally planar lower shell to conform to specified sight lines and aerodynamic planes for the vehicle.

SUMMARY OF THE INVENTION

The subject invention is directed to a stamp formed muffler comprising at least one internal plate formed to define a nonplanar portion having at least one channel formed therein. The internal plate may comprise peripheral portions which may be disposed to lie generally in a single plane. The nonplanar portion of the internal plate may extend generally in a first direction away from the peripheral portions, while the channels are formed to extend away from said first direction and generally back toward the peripheral portions. The channels formed in the internal plate may define a plurality of interconnected channels, or may define a plurality of separate channels which terminate at apertures, louvers, perforations or the like, such that the separate channels communicate with one another through chambers as described further below.

The muffler further comprises a pair of formed external shells. At least a portion of at least one of the external shells is formed to generally conform to the nonplanar portion of the internal plate. In particular, at least one external shell will comprise a nonplanar portion which is nestable with the nonplanar portion of the internal plate having the channel formed therein. The external shell, however, does not nest with the channels. Portions of the internal plate adjacent the channels therein will be disposed in generally face-to-face relationship with the corresponding portions of an external shell. However, the channels formed in the internal plate will extend generally away from the external shell such that a tube is formed by the channels and the opposed portions of the external shell. The tube may have a generally semicircular cross-sectional configuration. Alternatively, the external shell may have its own channels extending away from the internal plate to define tubes of circular cross section.

The internal plate and the external shell may be secured to one another for example by welding, at selected locations along opposed sides of the formed tubes. This nested and secured interengagement of the internal plate and the external shell will provide substantial reinforcement for the external shell to substantially prevent shell ring.

A second external shell may be secured to the opposed side of the internal plate, such that the internal plate is effectively sandwiched between the two external shells. However, the second external shell will not be fully nested with the first external shell and the internal plate secured thereto. Thus, one or more chambers will be defined between the second external shell and the internal plate nested to the first external shell. The chambers will be selectively disposed relative to the perforations, louvers, apertures or the like formed in the internal plates to define expansion chambers and/or low frequency resonating chambers. The second external shell may be generally planar to conform to an established sight line or aerodynamic plane on the underside of the vehicle. Alternatively, the second external shell may define formed chambers which extend away from the first external shell to achieve the required volume for attenuating the exhaust gas noise. The second external shell may be provided with arrays of grooves to prevent shell ring therein, such as described in the above referenced co-pending Application Serial No. 227,807.

The previously described embodiment could be formed with three plates. However, in certain embodiments, the required noise attenuation cannot be achieved with a muffler having only three plates. In these embodiments, a pair of internal plates may be provided. However, the two internal plates will not be disposed in generally face-to-face relationship as had been the case in the above described prior art. Rather, the second internal plate may be generally nested with the second external shell, and may be formed such that at least one tube is defined between the second internal plate and the second external shell. Appropriate apertures, louvers, perforations or the like may permit communication between the tubes formed by the first internal plate and the tubes formed by the second internal plate. Thus, the respective arrays of tubes may communicate with one another through a formed chamber. In this embodiment, the chambers of the muffler will be disposed generally internally on the muffler, and with the tubes being disposed generally externally thereon. The internal disposition of the chambers and the additional reinforcement achieved by the nested assemblies of internal plates and external shells achieves extremely effective attenuation of shell ring without the need for a separate external shell performing the sole function of dampening vibrations, as is the case with conventional mufflers having a separate outer wrapper.

DETAILED DESCRIPTION OF THE PREFERRED EMBODIMENT

Figure 1:
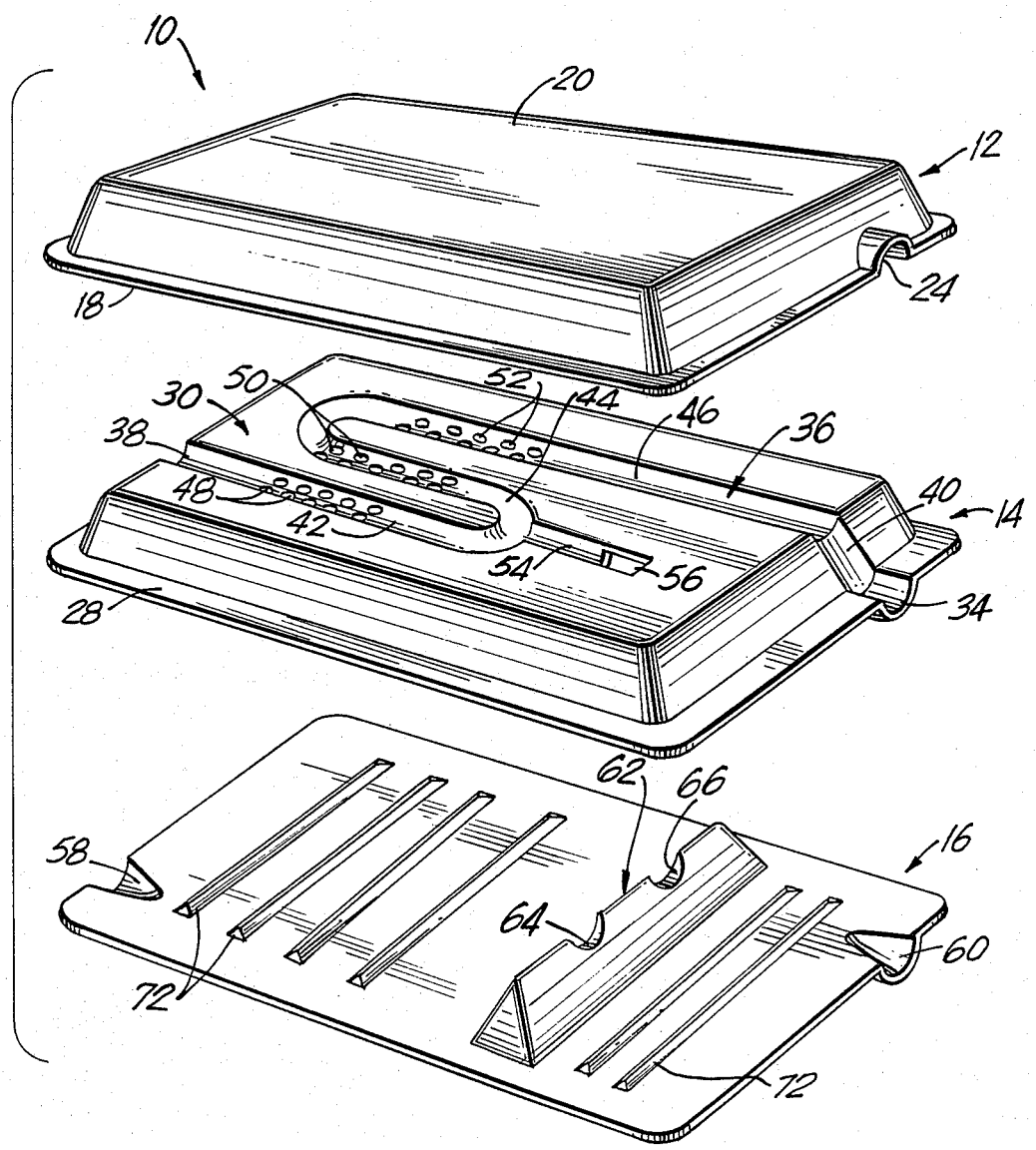
FIG. 1 is an exploded perspective view of a muffler in accordance with the subject invention.
Figure 2:
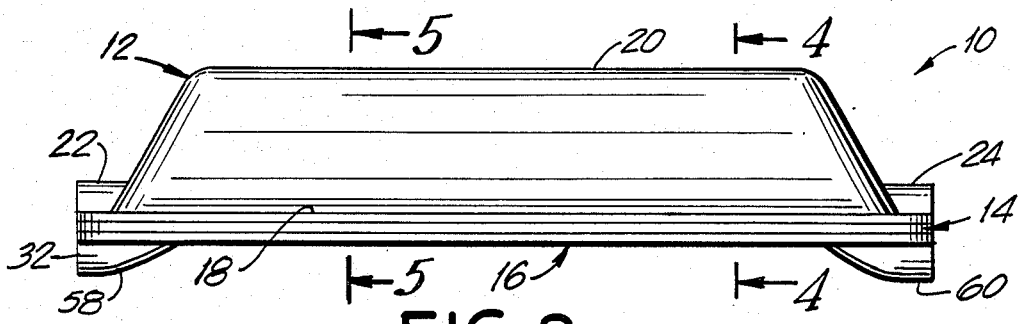
FIG. 2 is a side elevational view of the muffler shown in FIG. 1 in its assembled condition.
Figure 3:
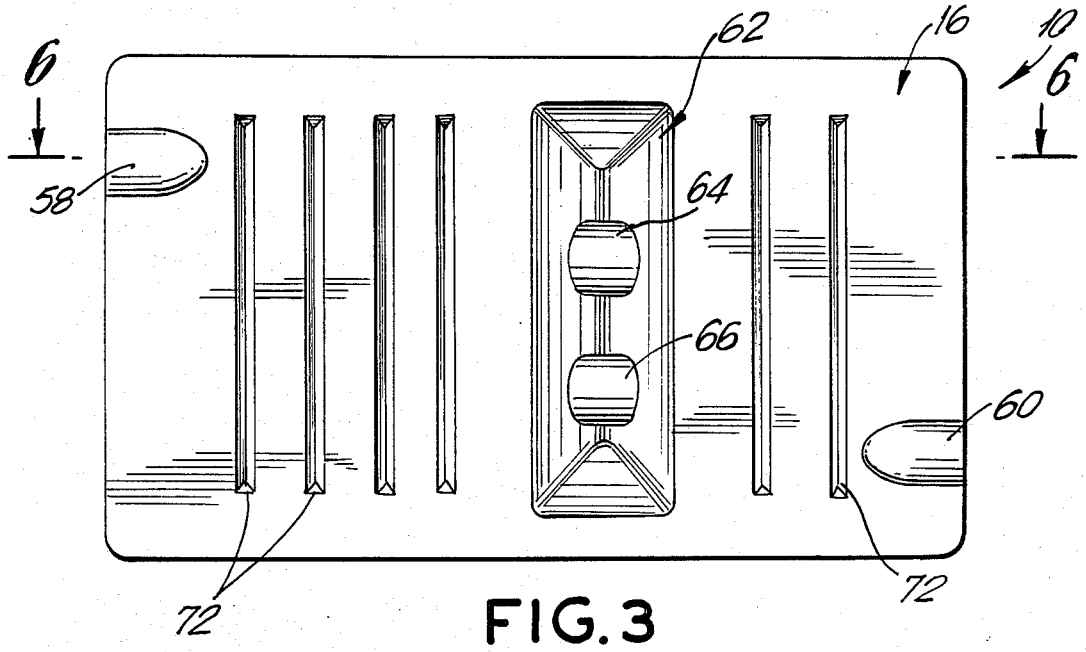
FIG. 3 is a bottom plan view of the muffler shown in FIG. 2.
Figure 4:
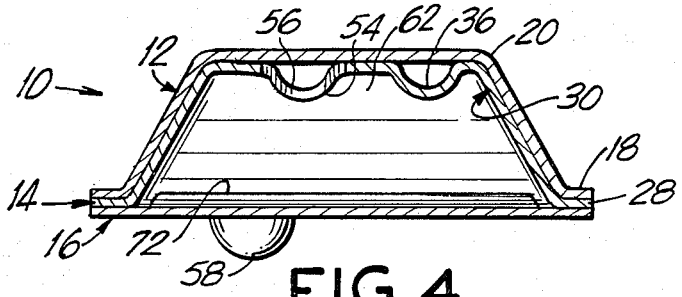
FIG. 4 is a cross-sectional view taken along line 4—4 in FIG. 2.
Figure 5:
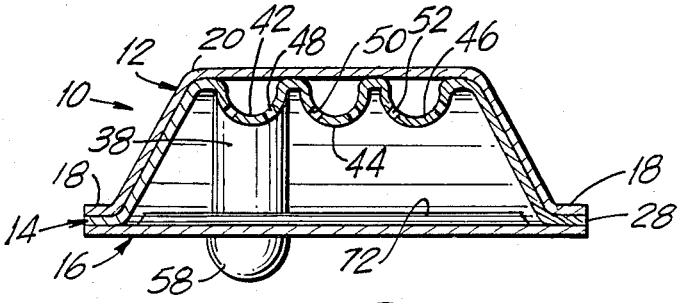
FIG. 5 is a cross-sectional view taken along line 5—5 in FIG. 2.
Figure 6:
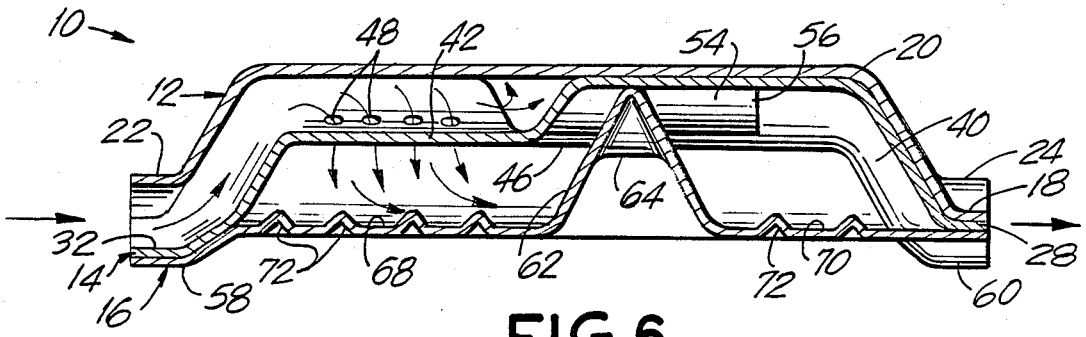
FIG. 6 is a cross-sectional view taken along line 6—6 in FIG. 3.

A muffler in accordance with the subject invention is identified generally by the numeral 10 in FIGS. 1–6. The muffler 10 comprises a first external shell 12, an internal plate 14 and a second external shell 16. The first and second external shells 12 and 16 and the internal plate are stamp formed from sheets of metal. It is to be understood, however, that metal forming methods other than stamping may be employed to provide the configurations explained and illustrated herein.

The first external shell 12 comprises a peripheral flange 18 and a nonplanar portion 20 extending away from the peripheral flange 18. In most embodiments the peripheral flange 18 will be generally planar to facilitate seam welding, spot welding, mechanical interconnection or other such connection of the muffler components. However, the planar configuration of the peripheral flange 18 as depicted in FIGS. 1–6 is not essential. The nonplanar portion 20 of the first external shell 12 is depicted as being depicted as being generally rectangular and substantially completely convex. However, the actual configuration of the nonplanar portion 20 will be selected in accordance with the available space on the vehicle. As a result, as explained in the co-pending application Serial No. 146,032, the first external shell 12 may comprise one or more concave portions configured to conform to the shape of a convex structure on a vehicle. It also should be noted that for the embodiment depicted in FIGS. 1–6, the first external shell 12 typically will define the upper shell of the muffler 10, and thus will be disposed in generally juxtaposed relationship to the underside of the vehicle.

The peripheral flange 18 of the first external shell 12 is characterized by generally arcuate nonplanar inlet and outlet flanges 22 and 24 respectively which will define portions of the inlet and outlet to the muffler 10, as explained further below. The arcuate inlet and outlet 22 and 24 extend from the peripheral flange 18 in generally the same direction as the nonplanar portion 20 thereof.

The internal plate 14 is formed to comprise a peripheral flange 28 and a nonplanar portion 30 extending therefrom. The peripheral flange 28 and the nonplanar portion 30 of the internal plate 14 are configured to be placed in generally nested relationship to the peripheral flange 18 and the nonplanar portion 20 of the first external shell 12. The peripheral flange 28 is further characterized by nonplanar inlet and outlet flanges 32 and 34 respectively which are disposed to be placed generally in register with the nonplanar inlet and outlet flanges 22 and 24 along the peripheral flange 18 of the first external shell 12. However, the nonplanar inlet and outlet flanges 32 and 34 extend in opposite directions from the nonplanar inlet and outlet flanges 22 and 24 to define inlet and outlet tubes therebetween.

The nonplanar portion 30 of the internal plate 14 is characterized by an array of channels identified generally by the numeral 36. More particularly, the array of channels 36 in the internal plate 14 comprises an inlet channel 38 aligned at an angle to the peripheral flange 28 and extending from the nonplanar inlet flange 32 thereof. The array of channels 36 further defines an outlet channel 40 which extends from the nonplanar outlet flange 34 at an angle to the plane defined by the peripheral flange 28. Interconnected channels 42–46 are further defined in the nonplanar portion 30 and extend between the inlet channel 38 and the outlet channel 40. The channels 42–46 are characterized by arrays of perforations 48–52 respectively. The perforations will permit the expansion and cross-flow of exhaust gas travelling through the muffler as explained further below. Although the perforations 48–52 are depicted as being generally circular apertures, other configurations of apertures or louvers may be provided.

The array of channels 36 further comprises a tuning channel 54 which communicates with the channels 42 and 44 and which terminates at a tuning aperture 56 formed entirely through the internal plate 14.

It should be noted that the array of channels 36 is formed in the internal plate to extend generally back toward the plane defined by the peripheral flange 28. Thus, the nonplanar portion 30 extends generally in a first direction away from the peripheral flange 28, while the array of channels 36 is formed in the nonplanar portion 30 but extending generally in an opposite direction therefrom. Thus, upon the nested assembly of the first external shell 12 and the internal plate 14, the channels 36 will extend away from the first external shell 12, while remaining portions of the internal plate 14 will be disposed generally in nested face-to-face relationship with the first external shell 12. By virtue of this configuration, the nonplanar array of channels 36 will define a generally nonplanar array of tubes.

The second external shell 16 is of generally planar configuration as depicted in FIGS. 1–6. However, the second external shell 16 is characterized by nonplanar inlet and outlet flanges 58 and 60 which are disposed to engage the inlet and outlet flanges 34 and 32 of the internal plate 14. The second external shell 16 is further characterized by a formed baffle 62 which is configured to generally nest with the nonplanar portion of the internal plate 14. The baffle 62 is characterized by arcuate portions 64 and 66. The arcuate portion 64 is dimensioned and disposed to closely engage the tuning channel 54 formed in the nonplanar portion 30 of the internal plate 14. Similarly, the arcuate portion 66 is disposed and configured to engage the channel 46 of the internal plate 14.

The muffler 10 is shown in its assembled condition in FIGS. 2–6. As shown most clearly in FIG. 6, the muffler 10 comprises an expansion chamber 68 disposed to substantially surround the arrays of perforations 48–52. The muffler 10 further comprises a low frequency resonating chamber 70 disposed to surround the tuning aperture 56 formed in the internal plate 14. The volumes defined by the expansion chamber 68 and the low frequency resonating chamber 70 are selected in accordance with the tuning requirements of the vehicle. Functionally, the expansion chamber 68 permits the expansion of exhaust gases through the perforations 48–52 to attenuate a broad frequency of noise associated with the exhaust gases flowing through the muffler 10. The low frequency resonating chamber communicates with the tube defined between the tuning channel 54 and the first external shell 12. In particular, the volume of the low frequency resonating chamber, the cross-sectional area of the tube defined by the tuning channel 54 and the length of the tuning channel 54 all are selected to attenuate a particular range of low frequency noise that is not adequately attenuated by the expansion chamber 68.

The first external shell 12 and the internal plate 14 preferably are spot welded or mechanically joined to one another at a plurality of locations across the nonplanar portions 20 and 30 thereof respectively. The spot welding or mechanical joining of the nested first external shell 12 and the internal plate 14 provides reinforcement which substantially eliminates shell ring attributable to the vibration of the walls of the chamber. The planar surfaces of the second external shell 16 may be provided with grooves or ridges 72 to prevent vibration of the second external shell 16 and thereby further insure a reduction or elimination of shell ring.

Figure 7:
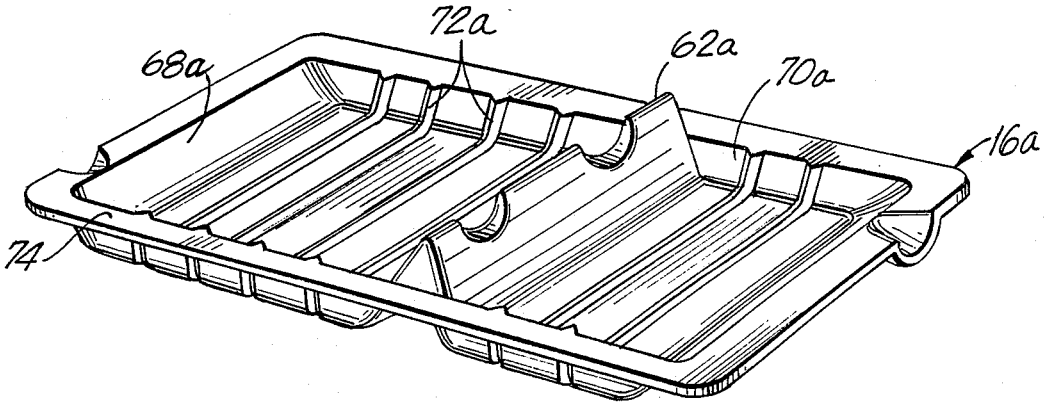
FIG. 7 is a perspective view of an alternate lower external shell to replace the corresponding external shell in FIGS. 1–6.
Figure 8:
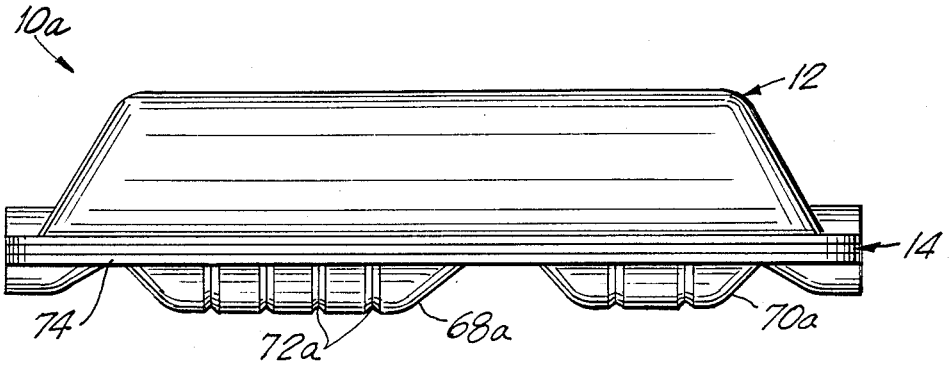
FIG. 8 is a side elevational view similar to FIG. 2 but incorporating the external shell of FIG. 7.

FIG. 7 shows an alternate second external shell **16*a* which is incorporated into a muffler 10*a* as depicted in FIG. 8. As shown most clearly in FIG. 7, the second external shell 16*a* is of substantially nonplanar configuration. In particular, the second external shell 16*a* includes a generally planar peripheral flange 74 which is configured and dimensioned to be placed generally in face-to-face contact with the peripheral flange 28 of the internal plate 14 as depicted most clearly in FIG. 1. The second external shell 16*a* includes a formed baffle 62*a* which is disposed and dimensioned to be placed in nested relationship to the nonplanar portion 30 of the internal plate 14. A nonplanar expansion chamber 68*a* is defined intermediate the baffle 62*a* and the planar peripheral flange 74. The nonplanar expansion chamber 68*a* is disposed and dimensioned to substantially surround the perforations formed in the internal plate 14. The second external shell 16*a* further comprises a nonplanar low frequency resonating chamber 70*a* which is disposed to substantially surround the tuning aperture 56 in the internal plate 14. The nonplanar configuration of the expansion chamber 68*a* and the low frequency resonating chamber 70*a* are selected to achieve a required volume for these chambers. In many situations the additional volume enabled by the nonplanar configuration of the expansion chamber 68*a* and the low frequency resonating chamber 70*a* will be required because the necessary volume cannot be achieved with the generally planar second external shell 16 depicted in FIGS. 1–6**.

The assembled configuration of the muffler **10*a* incorporating the second external shell 16*a* is shown most clearly in FIG. 8. The reinforcing grooves 72*a* shown most clearly in FIG. 8 preferably are similar to those described in co-pending application Serial No. 227,807. The mufflers 10 and 10*a* depicted in FIGS. 1–8 are desirable in that they enable the required tuning to be carried out with only three plates. Furthermore, the nonplanar configuration of the array of channels 36 and the nested configuration of the first external shell 12 and the internal plate 14** substantially eliminates shell ring.

Figure 9:
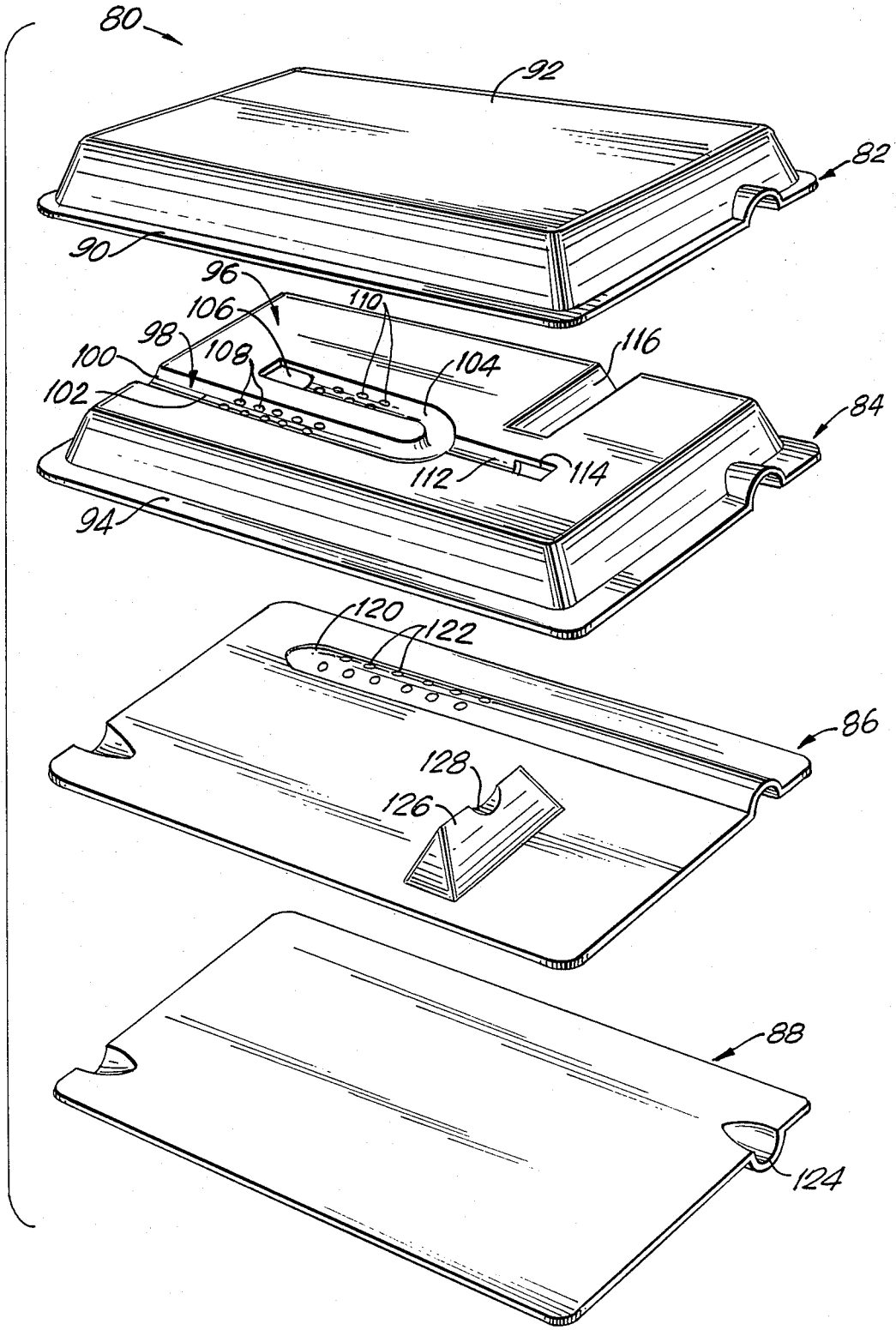
FIG. 9 is an exploded perspective view of an alternate muffler in accordance with the subject invention.
Figure 10:
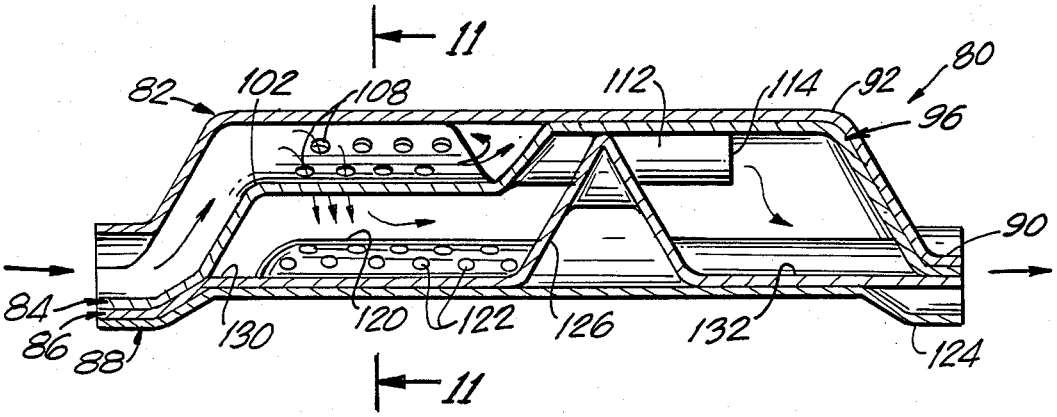
FIG. 10 is a cross-sectional view similar to FIG. 6 but showing the alternate embodiment.
Figure 11:
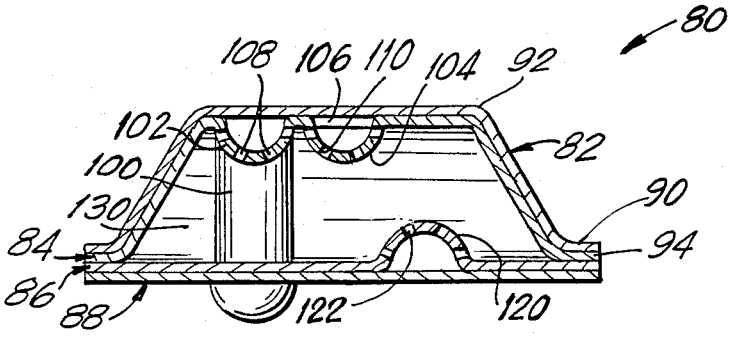
FIG. 11 is a cross-sectional view taken along line 11—11 in FIG. 10.

In many mufflers it may be desired to achieve tuning that cannot efficiently or effectively be carried out with only two plates. In these situations, a muffler comprising four plates may be employed, as shown in FIGS. 9–11. In particular, as shown most clearly in FIG. 9, a muffler 80 comprises a first external shell 82, a first internal plate 84, a second internal plate 86 and a second external shell 88. As with the previously described embodiments, the first external shell 82 comprises a generally planar peripheral flange 90 and a nonplanar portion 92 extending therefrom. The first internal plate 84 comprises a generally planar peripheral flange 94 and a nonplanar portion 96 extending therefrom. The peripheral flange 94 and the nonplanar portion 96 of the first internal plate 84 are configured to be placed in nested generally face-to-face relationship with the peripheral flange 90 and the nonplanar portion 92 of the first external shell, as had been described with the embodiments of FIGS. 1–8.

The nonplanar portion 96 of the first internal plate 84 is characterized by a nonplanar array of channels indicated generally by the numeral 98. The array of channels 98 comprises an inlet channel 100 angularly aligned to the peripheral flange 94. A channel 102 extends from the inlet channel 100 in generally spaced parallel relationship to the peripheral flange 94. Channel 104 extends from the channel 102 and terminates at aperture 106. The channels 102 and 104 are depicted as comprising arrays of perforations 108 and 110 respectively. The array of channels 98 further comprises a tuning channel 112 which terminates at a tuning aperture 114. It will be noted that the channels defined in the first internal plate 84 do not define an outlet channel from the muffler 80.

The nonplanar portion 96 of the first internal plate 84 is further characterized by a formed baffle 116 which extends generally back toward the plane defined by the peripheral flange 94.

The internal plate 86 is depicted as being of generally planar configuration but is characterized by a channel 120 having an array of perforations 122 formed therein. The channel 120 extends to an outlet flange 124 adjacent the periphery of the second internal plate 86. The second internal plate 86 is further characterized by a baffle 126 having an arcuate portion 128 formed therein. The baffle 126 is formed to be placed in generally nested relationship with the nonplanar portion 96 of the first internal plate 84, including the baffle 116 formed therein. In particular, in the assembled condition of the muffler 80, the baffle 116 and the baffle 126 will define a continuous baffle extending transversely across the muffler 80.

The second external shell 88 is depicted in FIG. 9 as being of generally planar configuration. As a result, the second external plate 88 can be placed in generally face-to-face relationship with the second internal plate 86 such that a tube will be defined between the second external shell 88 and the channel 120 formed in the second internal plate 86. It should be understood, however, that both the second internal plate 86 and the second external shell 88 can be formed to define nestable nonplanar configurations such as those depicted with respect to the first internal plate 84 and first external shell 82 or with respect to the previously described embodiments illustrated in FIGS. 7 and 8.

The muffler shown in FIG. 9 is assembled as shown in FIGS. 10 and 11. In this assembled condition, an expansion chamber 130 and a low frequency resonating chamber 132 are defined. The expansion chamber 130 substantially surrounds and encloses the portions of the tubes having the perforations 108, 110 and 122 formed therein. As a result, the exhaust gases may expand through the perforations and into the expansion chamber 130. Furthermore, the tubes defined by the array of channels 98 and the channel 120 are spaced from one another and define a clearly nonplanar array. In view of this configuration, a cross-flow of exhaust gases is efficiently achieved through the expansion chamber 130 enabling an efficient attenuation of a broad range of exhaust-related noise. Additionally, as with the previously described embodiment, the low frequency resonating chamber 132 substantially surrounds the tuning aperture 114 at the end of the tuning channel 112. The dimensions of the formed members can be selected to attenuate a particular low frequency range of noise.

In addition to achieving efficient expansion and cross-flow of exhaust gas through the expansion chamber 130, the muffler 80 depicted in FIGS. 9–11 substantially prevents shell ring. In particular, the nested configuration of the first external shell 82 with the first internal plate 84 and the corresponding nested face-to-face configuration of the second internal plate 86 and the second external shell 88 provide a double walled construction throughout the muffler 80. The double walled configuration and the internal disposition of the chambers provides enhanced dampening of shell vibrations and substantially eliminates shell ring.

In summary, a stamp formed muffler is provided with a nonplanar array of tubes defined between an external shell and an internal plate which are formed to be in nested generally face-to-face relationship. The efficient construction enables a muffler to be formed with only three formed components, while still achieving efficient tuning with minimal shell ring. In certain embodiments, the muffler may comprise four stamp formed components with the chambers being defined internally and with the tubes being defined at generally externally disposed locations. This configuration provides double walled chambers which are particularly effective in eliminating shell ring.

While the invention has been defined with respect to a preferred embodiment, it is apparent that various changes can be made without departing from the scope of the invention as defined by the appended claims.

We claim:

1. An exhaust muffler comprising:

a first external shell formed to define a peripheral portion and a nonplanar portion extending away from the peripheral portion;

an internal plate formed to define a peripheral portion and a nonplanar portion extending from said peripheral portion, said internal plate being formed to be placed in nested generally face-to-face relationship with the first external shell, said internal plate further being formed to define a nonplanar array of channels in the nonplanar portion of the internal plate, said channels being formed to be in spaced relationship to said first external shell when said internal plate and said first external shell are disposed in nested relationship to one another, such that an array of tubes are defined between the first external shell and the channels formed in the internal plate, said channels formed in the internal plate being provided with a plurality of aperture means for permitting the flow of exhaust from the array of channels, said array of tubes defined by said channels and by said first external shell defining at least one inlet to the muffler and at least one outlet from the muffler; and a second external shell secured to the peripheral portion of said internal plate such that at least one chamber is defined intermediate said second external shell and said internal plate.

2. An exhaust muffler as in claim 1 further comprising baffle means for defining a plurality of chambers intermediate said second external shell and said internal plate.

3. An exhaust muffler as in claim 2 wherein the baffle means is unitarily formed with said second external shell, said baffle means being formed to be in generally nested relationship with a part of the nonplanar portion of said internal plate.

4. An exhaust muffler as in claim 2 wherein said array of tubes comprises a tuning tube in communication with at least one other tube in said array, said tuning tube terminating at a tuning aperture formed in said internal plate, said pluralaity of chambers defining a low frequency resonating chamber substantially surrounding and enclosing the tuning aperture formed in the internal plate.

5. An exhaust muffler as in claim 1 wherein the nonplanar portions of said first external shell and said internal plate are secured to one another at a plurality of locations.

6. An exhaust muffler as in claim 5 wherein the nonplanar portions of said first external shell and said internal plate are secured to one another by welding.

7. An exhaust muffler as in claim 1 wherein the second external shell is formed to define a plurality of reinforcing ribs for preventing vibration related noise.

8. An exhaust muffler as in claim 1 wherein said second external shell is formed to define a nonplanar configuration.

9. An exhaust muffler as in claim 1 wherein the peripheral portions of said first external shell and said internal plate are generally planar.

10. An exhaust muffler as in claim 1 wherein said first external shell and said internal plate are stamp formed from metal material.

11. An exhaust muffler comprising:

a first external shell formed to define a peripheral portion and a nonplanar portion extending from said peripheral portion;

a first internal plate formed to define a peripheral portion and a nonplanar portion extending from said peripheral portion, said first internal plate being disposed in generally nested face-to-face relationship with said first external shell, said first internal plate further being formed to define at least one channel extending away from the first external shell, such that at least one tube is defined between said first external shell and said channel in said first internal plate, said channel being characterized by at least one aperture being formed therein;

a second internal plate secured to the peripheral portion of said first internal plate, said second internal plate being formed to be disposed in generally spaced relationship to at least selected areas of the nonplanar portions of said first internal plate, such that at least one chamber is defined intermediate said first and second internal plates, said second internal plate further being formed to define at least one channel extending generally into the chamber defined intermediate said first and second internal plates; and a second external shell formed and disposed in generally nested relationship to said second internal plate, such that at least one tube is defined intermediate said second external shell and the channel in said second internal plate, said tube defined by the first external shell and the channel in the first internal plate and the tube defined by the second external shell and the channel in the second internal plate defining an array of tubes, said array of tubes comprising at least one inlet to the muffler and at least one outlet from the muffler.

12. An exhaust muffler as in claim 11 wherein the first external shell and the first internal plate are secured to one another at a plurality of locations, and wherein the second external shell and the second internal plate are secured to one another at a plurality of locations, said secure connection reinforcing said muffler and preventing vibration related noise.

13. An exhaust muffler as in claim 11 further comprising baffle means extending between the first and second internal plates for defining a plurality of chambers therebetween.

14. An exhaust muffler as in claim 13 wherein at least one of said baffle means is formed unitarily with portions of at least one of said first and second internal plates.

15. An exhaust muffler as in claim 11 wherein said array of tubes in nonplanar.

16. An exhaust muffler as in claim 11 wherein the channel formed in said first internal plate defines a nonplanar array of channels.

* * * * *